US008347843B1

(12) United States Patent
Batiz-Vergara

(10) Patent No.: US 8,347,843 B1
(45) Date of Patent: Jan. 8, 2013

(54) PISTON FOR INTERNAL COMBUSTION ENGINE

(76) Inventor: José A. Batiz-Vergara, Caguas, PR (US)

( * ) Notice: Subject to any disclaimer, the term of this patent is extended or adjusted under 35 U.S.C. 154(b) by 107 days.

(21) Appl. No.: 13/065,653

(22) Filed: Mar. 25, 2011

(51) Int. Cl.
*F02F 3/20* (2006.01)
*F01P 1/04* (2006.01)

(52) U.S. Cl. ..... 123/193.6; 123/193.4; 123/41.34; 123/41.35; 123/197.2

(58) Field of Classification Search ..... 123/193.6, 123/193.4, 41.34, 41.35, 197.2
See application file for complete search history.

(56) References Cited

U.S. PATENT DOCUMENTS

| | | | | |
|---|---|---|---|---|
| 4,776,302 | A * | 10/1988 | Hundertmark et al. | 123/41.39 |
| 4,903,580 | A | 2/1990 | Bruni | |
| 4,987,865 | A | 1/1991 | Schenkel | |
| 5,058,489 | A | 10/1991 | Iwaya | |
| RE35,551 | E * | 7/1997 | Bruni | 92/158 |
| 6,186,110 | B1 | 2/2001 | Hamelink et al. | |
| 6,205,962 | B1 * | 3/2001 | Berry, Jr. | 123/73 A |
| 6,659,063 | B2 * | 12/2003 | Nomura et al. | 123/193.6 |
| 7,171,936 | B2 * | 2/2007 | Rein et al. | 123/193.4 |
| 7,377,206 | B2 | 5/2008 | Douglas | |
| 7,415,961 | B1 | 8/2008 | Chen et al. | |
| 7,600,465 | B2 | 10/2009 | Scharp | |
| 7,624,672 | B2 | 12/2009 | Sawada et al. | |
| 7,628,134 | B2 | 12/2009 | Scharp | |
| 7,748,361 | B2 | 7/2010 | Linz et al. | |
| 7,762,178 | B2 | 7/2010 | Scharp | |
| 7,789,064 | B2 | 9/2010 | Elsasser et al. | |
| 2006/0096557 | A1 * | 5/2006 | Christain et al. | 123/41.38 |
| 2009/0151688 | A1 * | 6/2009 | Matsui et al. | 123/193.6 |
| 2011/0139114 | A1 * | 6/2011 | Nakazawa et al. | 123/193.6 |

FOREIGN PATENT DOCUMENTS

JP 02211357 A * 8/1990

* cited by examiner

*Primary Examiner* — Noah Kamen
*Assistant Examiner* — Grant Moubry
(74) *Attorney, Agent, or Firm* — Hector M. Reyes Rivera

(57) ABSTRACT

A piston for internal combustion engines, having a series of conical openings at the center of each skirt section, each conical opening being horizontally located one to another and each conical opening in one skirt section aligned to another conical opening at the opposite skirt section. Each conical opening is also aligned to an oil drain hole at the oil groove located at the crown of the piston and having the external diameter larger that its internal diameter. Once installed, said conical openings forms an internal storing unit, wherein the oil or lubricant is stored and distributed constantly after being squirted out from the rod bearing to the piston, allowing the formation of a continuous lubricant film, without reducing the strength of the piston structure.

13 Claims, 5 Drawing Sheets

PISTON FOR INTERNAL COMBUSTION ENGINE

FIELD OF THE INVENTION

This invention is related to a piston for internal combustion engine and more particularly, the invention is directed to a piston for internal combustion engine, having conical openings on the piston skirt sections; each one of said openings being aligned to one oil drain hole located at the crown section of the piston. The alignment between said conical holes at the skirt and said oil drain hole facilitates the piston's lubricant flow while maintaining the required strength and integrity of the piston structure.

BACKGROUND OF THE INVENTION

The remarkable importance of a piston as essential part of internal combustion engines is well known in the art. In such engines, the combustion process of a fuel, such as gasoline or diesel, is used in combination with an oxidizer in order to generate power. The prior function of the piston is the transferring of energy produced by the combustion process into the rotational motion of the crankshaft, thus facilitating the inter conversion of the chemical energy into mechanical energy. Said energy transferring requires the translational motion of the piston through the cylinder's walls under extremes pressure, stress and temperatures conditions. Therefore, in order to function properly, the piston must maintain the expanded gases produced in the combustion chamber isolated from the crankshaft area, must move at a high speed through the walls of the cylinder, and must be able to transmit the motion from the connecting rod to the crankshaft and to disperse the heat produced in the process in an efficient manner. Said processes require a proper lubrication, particularly between the internal cylinder walls and the piston external surface, which is fundamental in order to increase the maintenance and high performance of the engine. The oil or lubricant assists the piston's performance by decreasing the power required to reduce friction, thus reducing the wear. Similarly, the lubricant also serves as a cooling agent of the piston by carrying away heat front the piston to the oil pan and also works as a dirt removal since it removes unwanted particulates such as carbon. Additionally, other advantages of the proper lubrication are the formation of a sealing interface between the piston rings and the cylinder walls that prevents loss of compression; cushioning of the parts against vibration and impacts; noise reduction and protection against corrosion.

The prior art discloses several examples, wherein particular apertures, openings or grooves on the surface of the piston's skirt are present as alternatives or solutions to increases said lubrication. For instant, U.S. Pat. No. 4,903,580 to Bruni discloses a piston having a series of elongated notches or grooves, located at both skirt surfaces and parallel to one another. Said grooves have an angular extension of 40 degrees since they are extended approximately 40 degrees centered about a lines perpendicular to the piston pin axis and a radial depth in a range of 0.005 to 0.05 mm. The interior side of such grooves is apparently straight, without any inclination or angle. The elongated geometry and the relative position of said grooves—parallel to each other and positioned along the surface of the skirt—present a potential weakness to the structural strength of the piston. Similarly, U.S. Pat. No. 7,415,961 to Chen et al. discloses a piston having different apertures or openings called reservoirs and channels, in diverse the forms of holes, grooves and indentions. Said diverse grooves or indentions have different shapes, depths and sizes and are located on the surface of the piston skirts in an irregular manner, without following a predetermined pattern, and without being limited to a particular section of the skirt or by even any particular quantity. Circular holes, elongated grooves of different sizes and design, cross sectional or I-shaped grooves may be present alone or in combination; giving place to multiple arrangements of possible combinations, thus without considering the potential effects on the particular characteristics of the piston such as strength of the resulting piston's structure.

The prior art however, does not discloses or suggests a piston having a series of conical holes at the piston skirt, horizontally positioned with regard to the piston pin axis and located substantially at the center of each skirt section; wherein each conical hole is aligned with a drain oil hole located at the piston crown and wherein the lubrication of the piston walls is increased by the lubrication flow formed by the coordination of the particular place of said conical openings, its alignment with the oil drain holes and the oil being squirted by the rod bearing.

SUMMARY OF THE INVENTION

An object of the instant invention is to provide a piston for an internal combustion engine, which is capable of increasing the lubrication of the internal cylinder walls and the piston surfaces, thus increasing the performance and the power of the engine. Accordingly, it is an object of the instant invention to provide piston that facilitates the oil or lubricant flowing; thus increasing the heat transferring or cooling capacity in the engine, and simultaneously, facilitates the removal of unwanted particles, reduces the noise and extends the life of the engine.

Another object of the instant invention is to provide a piston that increases the protection against corrosion by maintaining a continuous oil or lubricant film on the internal wall of the cylinder and external piston's wall of an internal combustion engine by a series of paired conical openings located at the piston skirt sections. Said conical openings are horizontally oriented one to another with regard to the pin axis of the piston and each one of them is in alignment with an oil drain hole at the piston crown. In yet another object of the invention is to increase the efficient use of fuel and increase a clean combustion process in internal combustion engines by the proper positioning of said conical holes with regard to the position of the piston impacted by the oil being squirted out from the rod bearing or drain from the internal top of the piston.

According to the instant invention, said objects are accomplished by a piston for internal combustion engine, wherein said piston comprises an upper section or crown and two skirt sections located in opposite position and located under said upper section or crown. The crown comprises at least one oil groove having multiple oil drain holes. The skirt sections comprises a skirt walls, at the left and right sides of the pin boss, wherein the only openings at said skirt sections wall are a series of conical openings passing through the skirt wall, each of said openings being aligned with at least one oil drain at the piston crown, each of said conical openings located substantially at the center of the piston skirt wall and horizontally aligned one to another and substantially located at the height of the piston pin axis, thus maintaining the required strength of the piston's structure. Each one of the conical opening in one skirt is also aligned to another conical opening in the opposite skirt section, thus providing aligned pairs of conical openings.

Since the larger diameter of said conical openings is on the external surface of the skirt and the smaller diameter is on the internal surface of the skirt, the side joining such external and internal diameters is angled from the external surface to the internal surface of the skirt sections. In this manner, once the piston is inserted in the cylinder, the internal wall of the cylinder and the external surface of the piston skirt walls create a pocket which area is extended from the external walls of the cylinder to the internal surface of the piston. Said pocket provides a place wherein the lubricant or oil is stored and distributed constantly in the space between the walls of the cylinder and the external surface of the skirt walls, thus creating a constant lubricant film between the internal walls of the cylinder and the external walls of the piston.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION OF THE EMBODIMENTS

The following detailed description illustrates the invention by way of example and is not limited to the particular limitations presented herein as principles of the invention. This description is directed to enable one skilled in the art to make and use the invention by describing embodiments, adaptations, variations and alternatives of the invention. Potential variations of the limitations herein described are within the scope of the invention. Although the instant description uses as an example a piston having a diameter of 85 mm crown, the same principles and limitations are applied to pistons having other crown length or sizes.

Figure 1:
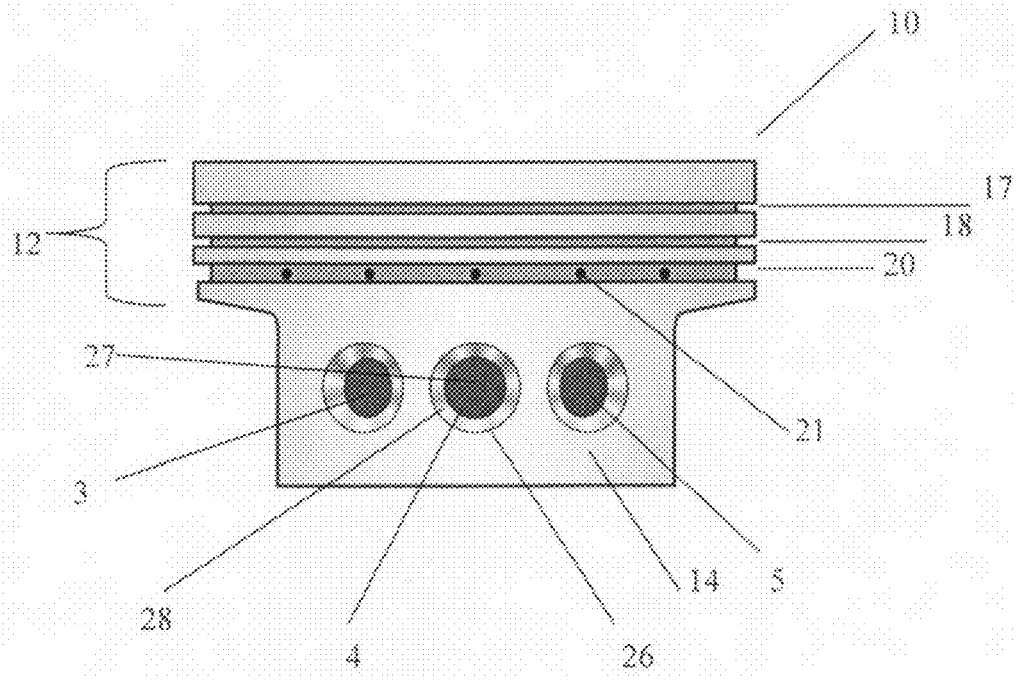
FIGS. 1-2 show front and side view, respectively, of one of the preferred embodiments of the piston according with the instant invention.
Figure 2:
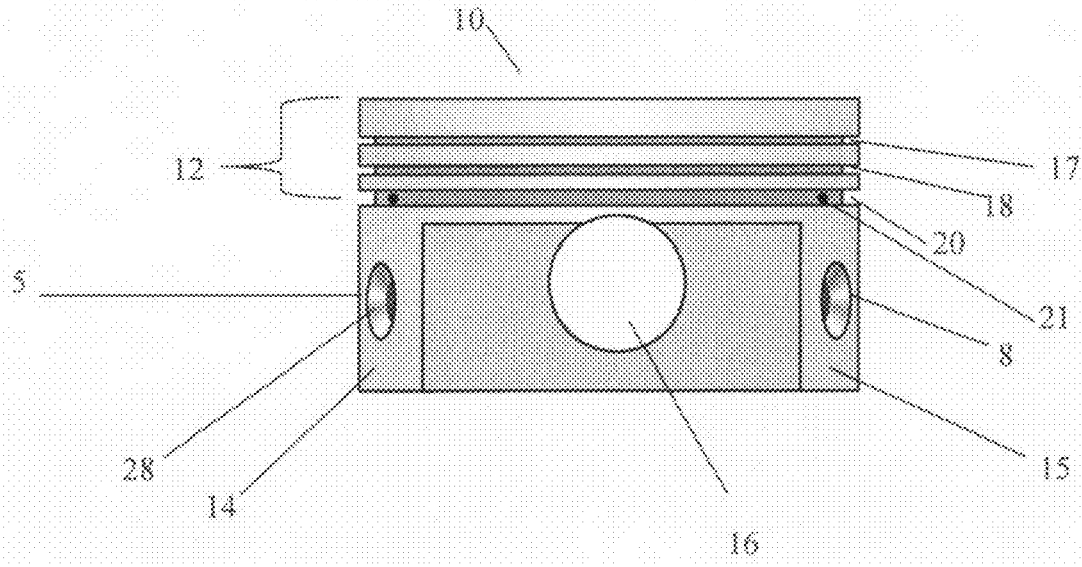

FIGS. 1, 2, 3 and 4 illustrate one preferred embodiment of a piston 10 for internal combustion engine or the like according to the instant invention. Said piston 10 comprises an upper section or crown 12, and two skirt sections 14 and 15, each of one located at opposite positions of pin boss 16 and under the crown 12. Particularly, FIG. 1 illustrates a front side view of the piston 10 having crown section 12, skirt section 14 in the front of the illustration and the piston skirt section 15 (not illustrated) at the back of skirt section 14. Similarly, 90 degrees rotation to the left on FIG. 1 provides FIG. 2, wherein piston 10 is illustrated showing the piston pin boss 16 at the center and skirt sections 14 and 15 at the left and right sides of the piston, respectively.

Figure 3:
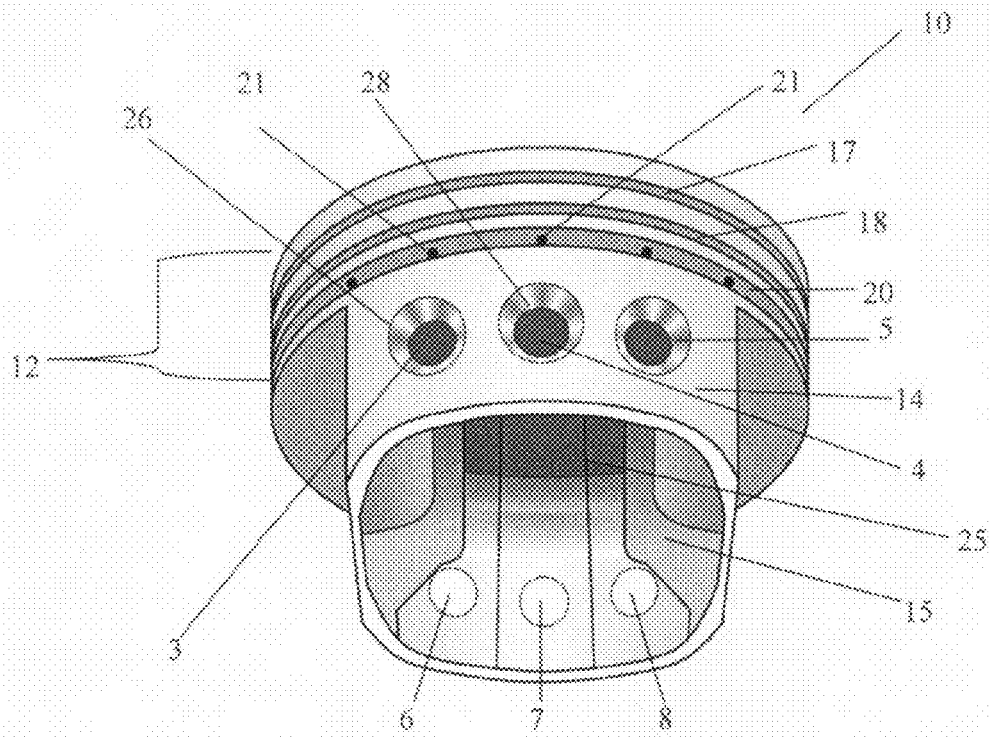
FIGS. 3 and 4 illustrate tridimensional views of the piston, illustrated in FIGS. 1 and 2 according to the invention, particularly showing the particular relative position of conical openings at the two piston's skirt sections and also to the drain holes at the piston's crown.
Figure 4:
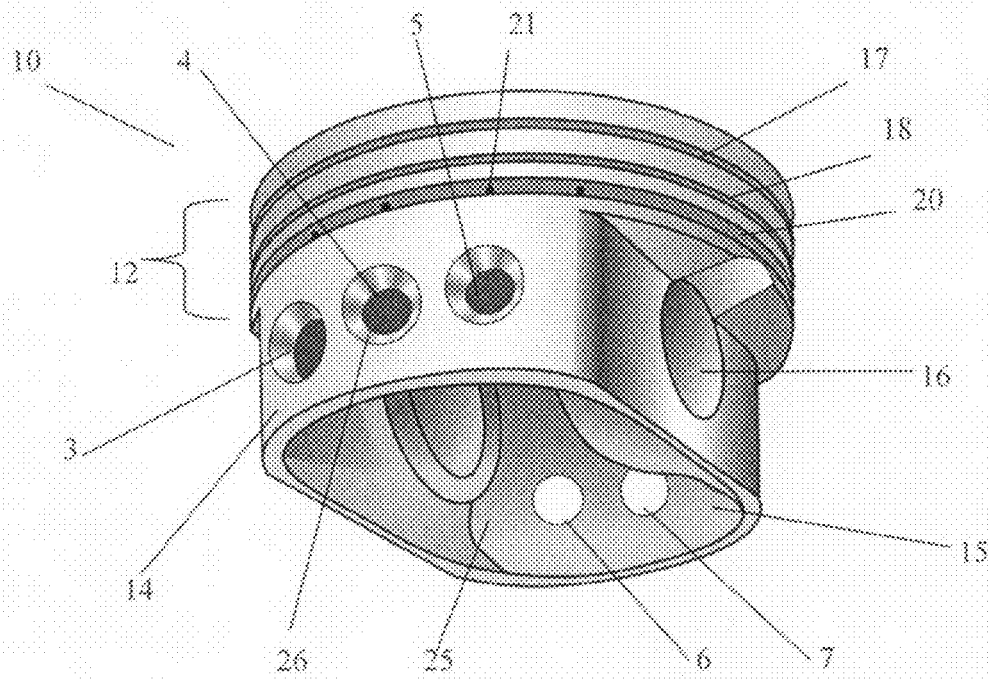

FIGS. 3 and 4 illustrate tridimensional views of piston 10. Particularly, FIG. 3 illustrates a tridimensional elevated front view of embodiment piston 10 while FIG. 4 illustrates an elevated left side view.

As illustrated in FIGS. 1 through 4, the preferred embodiment 10 also comprises at least two compression grooves 17, 18 and at least one oil groove 20 located at the lower end of crown 12. As illustrated, all such grooves are located at the crown 12.

Inside the oil ring groove 20, there are present a multiple oil drain holes 21, each of said holes passing through the internal wall of groove 20, thus allowing the communication of fluids from the internal cavity 25 of the piston 10 to the oil ring groove 20 and vice versa. Once there is an excess of oil or lubricant in the internal cavity 25 of the piston 10, it may easily move to the groove 20 via drain holes 21; from where it may drain downwardly to the external walls of piston 10.

Similarly, piston 10 also comprises three conical openings 3, 4, 5; which are substantially located at the center of the skirt sections 14 and three conical openings 6, 7 and 8; which are substantially located at the center of the skirt section 15. Each conical opening is positioned horizontally one to another at the center of the skirt section, in such matter that the structural strength of piston 10 is not debilitated or weaken. Similarly, each conical opening at a given skirt section is aligned to another conical opening at the opposite skirt section, thus creating an aligned conical opening pairs 3-6; 4-7 and 5-8.

Similarly, each conical opening has its larger diameter 26 at the external surface of the skirt while its smaller diameter 27 is on the internal surface of the skirt, thus the angled inner side 28 creates a conical pocket; wherein oil or lubricant is stored and distributed constantly.

In general terms, the internal diameter is at least 25 percent smaller than the external diameter. The particular sizes of the external and internal diameters of said conical openings depend on the particular size of the piston. More specifically, the external diameter may have a length in a range of 16 mm to 10 mm while the internal diameter may have a range of 12.7 to 6.35 mm. For instance, for a piston having a diameter of 85 mm crown length, the external diameter of the conical openings has a preferably length of 12.70 mm while the internal diameter is preferably of 9.52 mm. The inner side 28 has an inclination angle of 30 to 60 degrees.

Preferably, such inclination angle is between 40 to 50 degrees and even more preferably of 45 degrees. Once the piston 10 is inserted in a cylinder, such angled inner side 28 provides the required area for an internal storing unit in order to store oil or lubricant continuously, as mentioned above and explained in details below.

Figure 5:
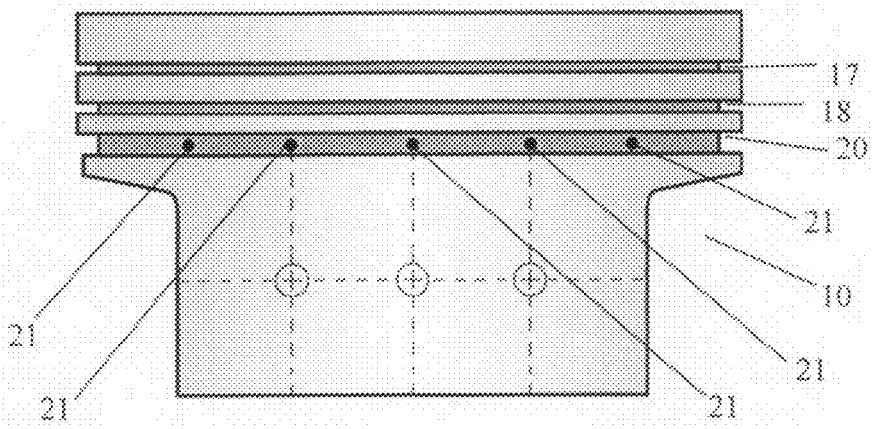
FIG. 5 illustrates the piston, according to the invention and previous to the insertion of conical openings on the surface of the skirt, pointing out the centralized position of each conical opening.
Figure 6:
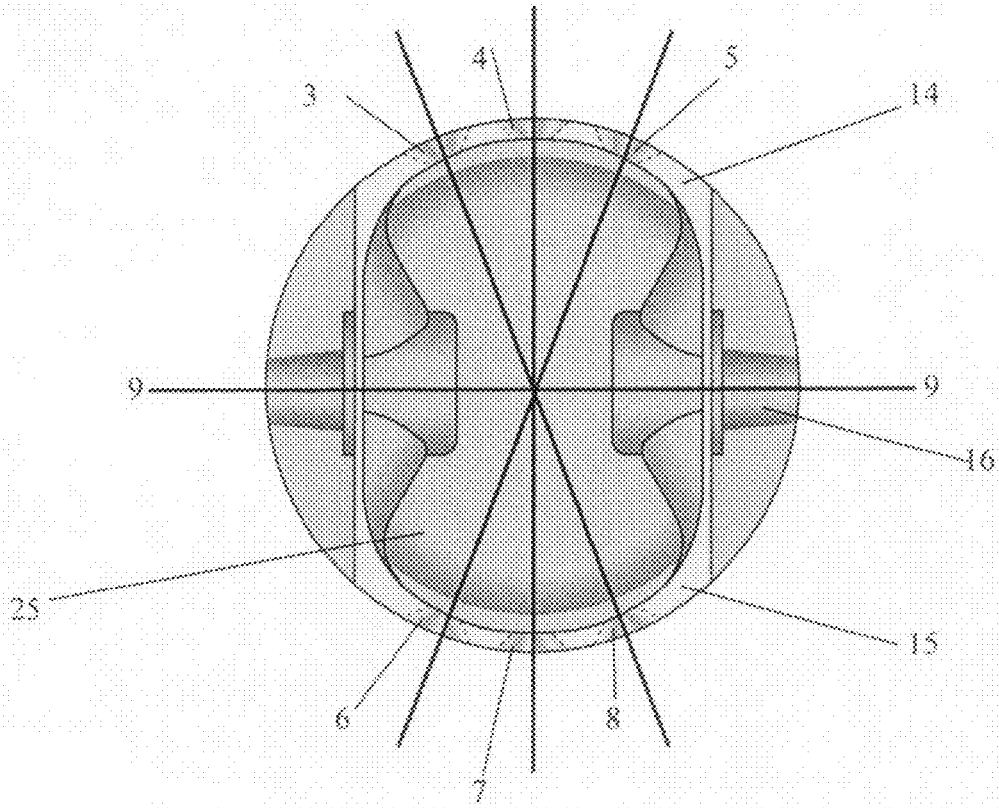
FIG. 6 is a view of the internal cavity of the piston according to the invention, as seen from the piston's bottom, illustrating the relative position of the conical openings at the center of the skirt sections with respect to the axis of the piston pin boss.
Figure 7:
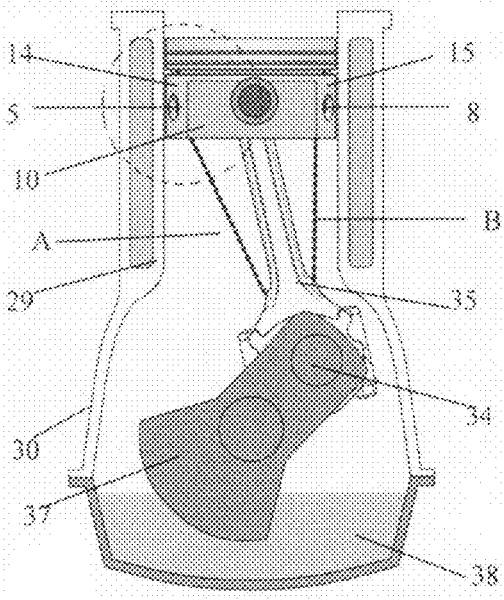
FIGS. 7 and 8 illustrate a front cross sectional view of a cylinder of an internal combustion engine, wherein an embodiment of the piston according to the instant invention is already assembled and wherein the front section in the cylinder has been cut away in order to illustrate one of the conical openings on the piston's skirt. In said FIGS. 7 and 8, the two main oil path or lubricant flow-route (A-B-C-D) are shown.
Figure 8:
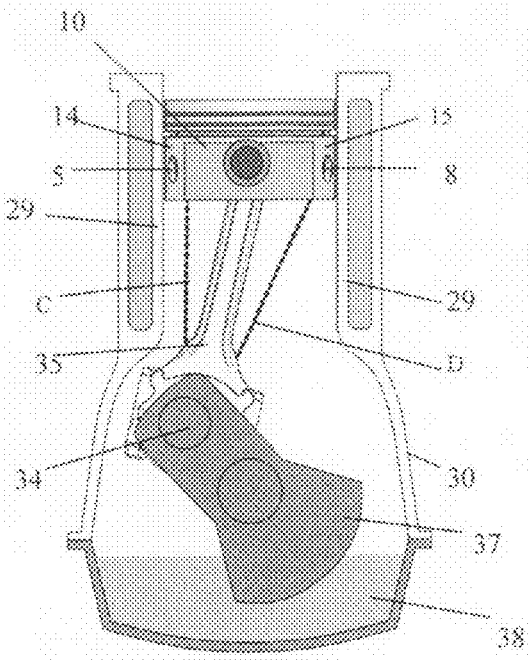

The particular and relative position of each one of the conical openings 3 through 8 are illustrated in FIG. 6 in reference to the axis 9 passing thorough the center of pin boss 16. As illustrated in FIG. 5, conical openings 4 and 7 are aligned to each other and are positioned in a perpendicular angle with respect to axis 9. Line 40 illustrates said alignment. Similarly conical openings 3 and 6 are aligned to each other and are located at a preferred angle with a range of 60 to 70 degrees with respect to then left side of axis 9. More preferably, such conical openings are in an angle of 65 degrees with respect to the left side of axis 9. In a similar manner, conical openings 5 and 8 are aligned to each other and are positioned at a preferred angle of 60 to 70 degrees with respect to the right side of axis 9. More preferably, such conical openings are in an angle of 65 degrees with respect to the right side of axis 9. Such indicated preferred shape and positions for the conical openings—substantially round in geometry and positioned one next to the other in a horizontally manner and substantially perpendicular to the central axis of pin boss 16—prevents the potential cracking of the piston structure and allows a more uniform distribution of the extreme conditions of temperature and pressure on piston 10. Furthermore, it facilitates the receiving, storing and distribution of lubricant or oil squirted out from the rod bearing 35, as illustrated in FIGS. 7 and 8.

As illustrated in FIGS. 1 through 4, at least one of the oil drain hole 21 has its internal diameter aligned to or perpendicularly positioned with respect to the conical openings. Such particular alignment allows that the lubricant or oil flowing though drain holes 21 falls directly within storing unit or pocket created by the angled side 28 of the conical openings and the internal walls 29 of the cylinder 30, as further discussed below.

It should be point out that, even though the skirt sections 14 and 15 of piston 10 are herein illustrated in a rectangular size, the skirt sections 14 and 15 may be of diverse sizes and geometrical design; different to those illustrated herein.

In order to make piston 10, the piston's main body may be obtained by procedures known in the art, such as casting; after which the position of the conical openings 3 through 8 are centralizing in the skirt sections 14 and 15 as illustrated in FIG. 5 and finally, the piston 10 is obtained after the such openings are crafted with the proper tool, such as a countersink or any other convenient tool known in the art. Alternatively, the piston 10 may be obtained directly by casting it as a single piece with the proper conical openings and the further limitations described herein.

FIGS. 7 and 8 illustrate the operational terms of piston 10, wherein it has been already assembled inside the cylinder of the internal combustion engine. For illustration purposes, the front section of the cylinder 30 on FIGS. 7 and 8 has been cut away in order to at least illustrate one pair of the conical openings, 5 and 8. Once assembled, the external diameter 26 of conical openings 5 and 8 are facing the internal wall of the cylinder 30, thus creating storing units or pocket areas for the lubricant or oil, since the angled side 28 allows for the creation of an internal space once facing said internal cylinder walls 29. During the process of using the piston 10, the rotational movement of the crankshaft 37 transfers oil from the oil pan 38 to the connecting rod 34, from where it is squirted out from the rod bearing 35 more directly to conical openings 4 and 7 (not illustrated), which are located at the center of the skirt sections 14 and 15 respectively. Similarly and simultaneously, oil or lubricant are also splashed around the internal cavity 25 of piston 10, from where it drains down to the storing units creates by the conical openings 3, 6 and 5, 8 and in the internal cylinder walls 29. In the continuous movement of the piston, the stored oil or lubricant in constantly spread around the space between the internal walls 29 of the cylinder 30 and 10 external wall of piston 10, thus creating a lubricant film in said section. At the meanwhile, more oil is distributed from and constantly replaced into said storing units in a constant manner as already indicated.

Similarly, oil or lubricant squirted out on the internal cavity 25 of piston 10 drains downwardly though the oil drain holes 21, from where it may moves downwardly to the oil groove and from there to the storing units created by said conical openings 3-8. Due to the surface tension of the oil or lubricant, each lubricant molecule is pulled in the same direction by neighboring oil molecules, thus creating the desired oil or lubricant flow route that is channeled in the particular structure of piston 10.

Since the movement of the crankshaft 37 is circular, as illustrated in FIG. 7, at a given moment, the oil being squirted out at the left side is deposited on the conical opening 4 (not illustrated) as indicated by route (A). The adjacent conical openings 3 and 5 are also filled out with oil by dispersion after it impacts the internal walls of the piston 10. In route (B), illustrates the oil is squirted out into the internal cavity 25 of piston 10.

On the other hand, FIG. 8 illustrates an opposite situation once the crankshaft 37 had been rotated. As illustrated in route (C), the oil is squirted out directly at the internal top side 25 of piston 10; while in route (D), illustrates the point when the oil or lubricant is squirted out into the conical opening 7 (not illustrated) and by its dispersion, to the conical openings 6 and 8. As it is well known, the movement of the crankshaft 37 is continuous and fast, thus as mentioned before, the oil is constantly being squirted out to the storing units formed by the angled conical openings 3-8. Thus, the constant movement of piston 10 constantly disperses the oil or lubricant stored and distributed in such pockets, creating a continuous oil film inside the space between the internal cylinder walls 29 and the external surface of piston 10. Oil or lubricant drained from oil groove 20 also contributes to the formation of the film due to the fact that six of such drain holes 21 are aligned to each conical opening, as explained previously.

Figure 9:
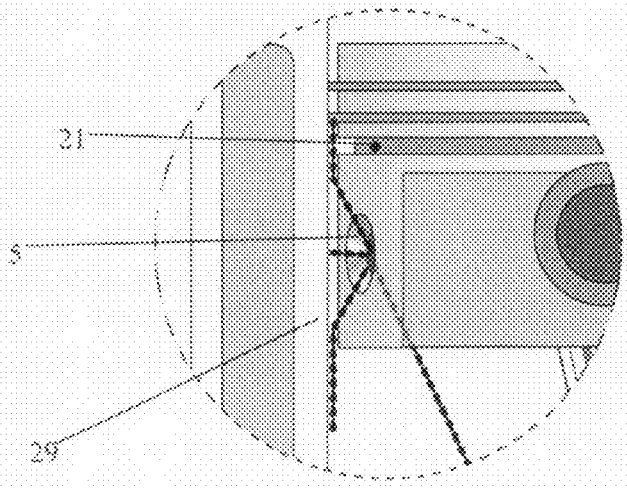
FIG. 9 illustrates an expanded view of a section of FIG. 7, wherein using droplets, the main lubricant flow or main oil distribution route from the oil pan to the internal section of the conical opening at the piston skirt is shown. Accordingly, the oil or lubricant is continuously stored in the conical holes and continuously dispersed along the space between the internal surface of the cylinder walls and the external surfaces of the piston.

FIG. 9 illustrates an expanded section of FIG. 7, showing a constant oil distribution wherein the oil is dispersed from the conical opening 5 to the lower and upper section of the spacing between the internal walls of the cylinder 29 and the external walls of the piston 10. Some oil squirted out to the internal cavity 25 of the piston 10 drains thorough oil holes 21, from where it is also dispersed to the storing pockets created by the conical holes 3 through 8 once the piston moves upwardly and downwardly.

Figure 10:
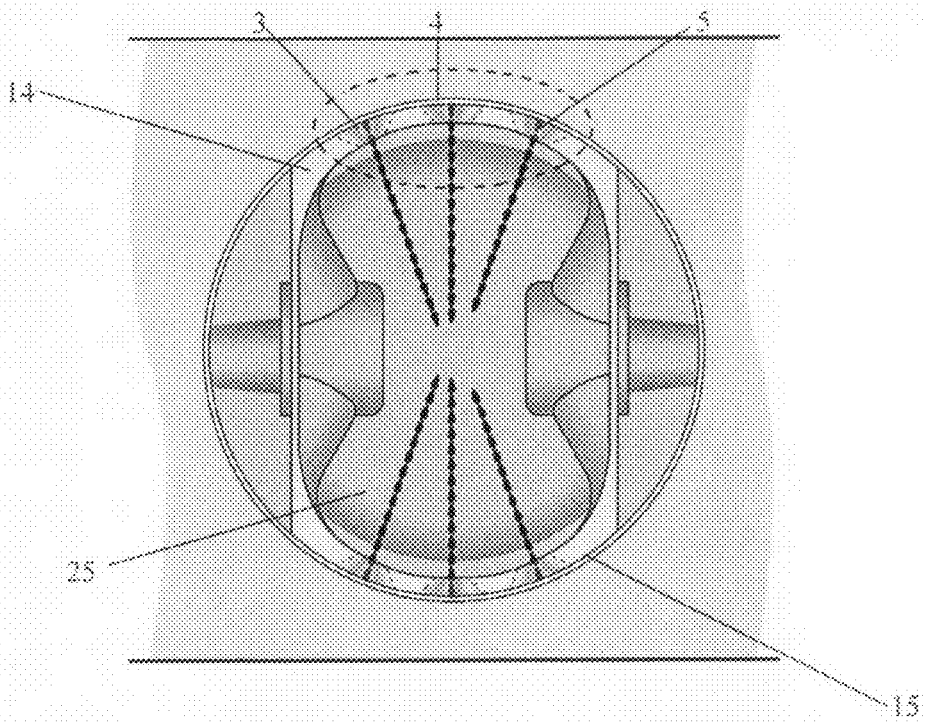
FIG. 10 illustrates the interior top section of the piston according with the invention, as seen from the bottom section of the piston, particularly showing the lubricant route flowing or oil distribution route from the top internal section of the piston to the conical openings at the piston's skirt.
Figure 11:
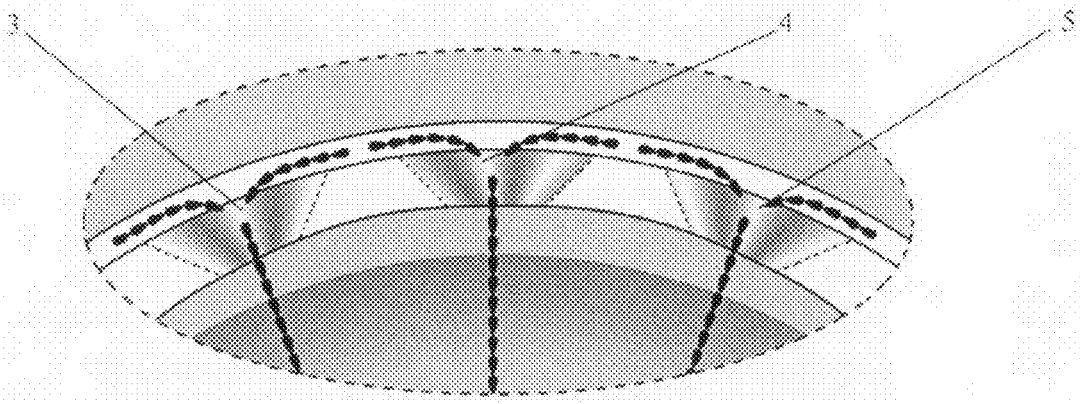
FIG. 11 illustrates expanded area of a section of FIG. 10, particularly showing the oil or lubricant route, wherein the excess of lubricant flows from the top internal section of the piston to the conical openings at the piston's skirt; from where the flow is dispersed continuously to the space between the external walls of the piston's skirt and the internal wall of the cylinder.

Alternatively, another portion of the oil or lubricant squirted out to the internal cavity of piston 10 drains through the internal walls of piston 10, as illustrated in FIG. 10, from where it descends or drains from the interior of the piston cavity 25 to the pockets created by conical holes 3 through 8. FIG. 12 illustrate an explode view of a section of FIG. 10, showing the details of the oil distribution from the internal cavity 25 of piston 10 to the storing units created by the conical openings 3-through 8; from where it moves to the inner space between the cylinder internal walls 29 and the external surface of the skirt sections of the piston 10.

What is claimed is:

1. A piston for carrying out reciprocal movement in an internal combustion engine cylinder, said piston comprising:

a crown upper section;

at least one oil groove at a lower section of said crown upper section;

multiple oil drain holes passing through an oil groove external and internal ends, thus creating drain channels;

two skirt sections located under said crown upper section and in opposite position one to the other;

each of said skirt sections comprising:

a wall having an exterior surface and an internal surface;

conical openings, passing through the exterior surface to the internal surface of said wall, wherein said conical openings are the only openings at the skirt sections and wherein said conical openings are located horizontally one to another at substantially a vertical center of said wall and;

wherein a larger diameter of the conical openings is located at the external surface of the skirt and a smaller diameter of the conical openings is located at the internal surface of the skirt, thus creating an internal angled side joining said external diameter to said internal diameter and wherein each conical opening in a given skirt section is aligned to another conical opening in the opposite skirt section and wherein a center of the smaller diameter of each conical opening is aligned to a center of one oil drain hole at the oil groove and;

wherein, once the piston is inserted in the cylinder, an internal cylinder wall and the external surface of the piston skirt creates an internal storing area on each conical angled opening where an oil or lubricant is stored and distributed constantly, thus creating a constant lubricant film between the internal walls of the cylinder and the external surface of the skirt.

2. The piston as recited in claim 1, wherein there are three conical openings in each skirt section.

3. The piston as recited in claim 2, wherein an angle of the internal angled side of the conical opening is in a range of 30 to 60 degrees.

4. The piston as recited in claim 3, wherein the angle of the internal angled side of the conical opening is in a range of 40 to 50 degrees.

5. The piston as recited in claim 4, wherein the angle of the internal angled side of the conical opening is 45 degrees.

6. The piston as recited in claim 2, wherein the larger diameter of the conical opening has a length in a range of 16 to 10 mm.

7. The piston as recited in claim 6, wherein the larger diameter of the conical opening has a length in a range of 14 to 11 mm.

8. The piston as recited in claim 7, wherein the larger diameter of the conical opening has a length of 12.7 mm.

9. The piston as recited in claim 2, wherein the smaller diameter of the conical opening has a length in a range of 12.7 to 6.35 mm.

10. The piston as recited in claim 9, wherein the smaller diameter of the conical opening has a length in a range of 10.52 to 8.52 mm.

11. The piston as recited in claim 10, wherein the smaller diameter of the conical opening has a length of 9.52 mm.

12. The piston as recited in claim 2, wherein an external diameter of the crown upper section is 85 mm.

13. A piston for carrying out reciprocal movement in an internal combustion engine cylinder, said piston comprising:

a crown upper section;

at least one oil groove at a lower section of said crown upper section;

multiple oil drain holes passing through an oil groove external and internal ends, thus creating drain channels;

two skirt sections located under said crown upper section and in opposite position one to the other;

each of said skirt sections comprising:

a wall having an exterior section and an internal section;

at least two conical openings, passing through the exterior section to the internal section of said wall, wherein said openings are located horizontally one to another at substantially the center of said wall and;

wherein a larger diameter of the conical openings is located at the external surface of the skirt and a smaller diameter of the conical openings is located at the internal surface of the skirt, thus creating an internal angled side joining said external diameter to said internal diameter and wherein each conical opening in a given skirt section is aligned to another conical opening in the opposite skirt section and wherein a center of the smaller diameter of each conical opening is aligned to a center of one oil drain hole at the oil groove and;

wherein, once the piston is inserted in the cylinder, an internal cylinder wall and the external surface of the piston skirt creates an internal storing area on each conical angled opening where an oil or lubricant is stored and distributed constantly, thus creating a constant lubricant film between the internal walls of the cylinder and the external surface of the skirt.

* * * * *